US006047899A

United States Patent [19]

Graves

[11] Patent Number: 6,047,899

[45] Date of Patent: Apr. 11, 2000

[54] HYDRAULICALLY-ACTUATED FUEL INJECTOR WITH ABRUPT END TO INJECTION FEATURES

[75] Inventor: Jeffrey D. Graves, Chenoa, Ill.

[73] Assignee: Caterpillar Inc., Peoria, Ill.

[21] Appl. No.: 09/023,694

[22] Filed: Feb. 13, 1998

[51] Int. Cl.[7] ..... F02M 47/02

[52] U.S. Cl. ..... 239/90; 239/88; 239/89; 239/96; 239/533.8

[58] Field of Search ..... 239/533.1, 533.2, 239/533.8, 124, 88, 89, 90, 91, 92, 96, 95; 123/447, 500, 503, 506

[56] References Cited

U.S. PATENT DOCUMENTS

| | | | |
|---|---|---|---|
| 2,950,709 | 8/1960 | Bessiere | 123/139 |
| 3,961,612 | 6/1976 | Okamoto et al. | 123/139 E |
| 4,258,674 | 3/1981 | Wolff | 123/446 |
| 4,372,272 | 2/1983 | Walter et al. | 123/467 |
| 4,408,586 | 10/1983 | van Rinsum | 123/446 |
| 4,605,166 | 8/1986 | Kelly | 239/96 |
| 4,750,462 | 6/1988 | Egler et al. | 123/467 |
| 5,413,076 | 5/1995 | Koenigswieser | 123/446 |
| 5,443,209 | 8/1995 | VanAllsburg | 239/90 |
| 5,522,545 | 6/1996 | Camplin et al. . | |
| 5,709,341 | 1/1998 | Graves | 239/92 |
| 5,713,520 | 2/1998 | Glassey et al. | 239/92 |
| 5,871,155 | 2/1999 | Stockner et al. | 239/92 |
| 5,873,527 | 2/1999 | Pattanaik | 239/91 |
| 5,894,992 | 4/1999 | Liu et al. | 239/91 |

FOREIGN PATENT DOCUMENTS

| | | |
|---|---|---|
| 62218638 | 9/1987 | Japan . |
| 2 307 521 | 5/1997 | United Kingdom . |
| 2 234 125 | 10/1998 | United Kingdom . |
| 98/46876 | 10/1998 | WIPO . |

*Primary Examiner*—Andres Kashnikow
*Assistant Examiner*—David Deal
*Attorney, Agent, or Firm*—Michael McNeil

[57] ABSTRACT

A hydraulically-actuated fuel injector includes an injector body that defines an upper actuation fluid cavity, a lower actuation fluid cavity, an actuation fluid inlet, a spill passage, a piston bore and a nozzle outlet. A control valve member is positioned in the injector body and moveable between a first position and a second position. An intensifier piston is positioned in the piston bore and moveable between a retracted position and an advanced position. The piston has a primary hydraulic surface exposed to fluid in the upper actuation fluid cavity, and an opposing hydraulic surface exposed to fluid in the lower actuation fluid cavity. The upper actuation fluid cavity is open to the actuation fluid inlet, and the lower actuation fluid cavity is open to the spill passage when the control valve member is in its first position. The spill passage is blocked when the control valve member is in its second position.

20 Claims, 3 Drawing Sheets

HYDRAULICALLY-ACTUATED FUEL INJECTOR WITH ABRUPT END TO INJECTION FEATURES

TECHNICAL FIELD

This invention relates generally to hydraulically-actuated fuel injectors, and more particularly to features in such fuel injectors that provide for a more abrupt end to an injection event.

BACKGROUND ART

Over time, engineers have come to recognize that undesirable engine emissions can often be reduced by providing for a more abrupt end to each injection event. In other words, undesirable soot, NOx and noise emissions can usually be reduced at most engine operating conditions when the injection flow rate curve at the end of an injection event is nearly vertical. The prior art is replete with a wide variety of methods and means for providing more abrupt ends to injection events for the many types of fuel injectors currently known. For instance, one known method of seeking a more abrupt end to an injection event is to provide a means for spilling fuel pressure at the end of an injection event in the hopes of hastening the closure rate of the needle check valve, which opens and closes the nozzle outlet of the fuel injector. In another example, some fuel injection systems seek a more abrupt end to an injection event by applying hydraulic fluid pressure to an upper end of the needle valve member in the hopes of hastening its closure rate at the end of an injection event.

The present invention is directed to these and other problems associated with providing a more abrupt end to injection events in hydraulically-actuated fuel injectors.

DISCLOSURE OF THE INVENTION

A hydraulically-actuated fuel injector includes an injector body that defines a first actuation fluid cavity, a second actuation fluid cavity, an actuation fluid inlet, a spill passage, a piston bore and a nozzle outlet. A control valve member is positioned in the injector body and moveable between a first position and a second position. An intensifier piston is positioned in the piston bore and moveable between a retracted position and an advanced position. The piston has a primary hydraulic surface exposed to fluid in the first actuation fluid cavity, and an opposing hydraulic surface exposed to fluid in the second actuation fluid cavity. The first actuation fluid cavity is open to the actuation fluid inlet, and the second actuation fluid cavity is open to the spill passage when the control valve member is in its first position. The spill passage is blocked when the control valve member is in its second position.

In another embodiment, a hydraulically-actuated fuel injection system includes a fuel injector that has an actuation fluid inlet, a fuel inlet, a nozzle outlet and means, including a hydraulically driven piston, for pressurizing fuel in the fuel injector. A source of high pressure actuation fluid is connected to the actuation fluid inlet. A source of low pressure fuel is connected to the fuel inlet. The system also includes means for hydraulically stopping the piston when the piston is moving from its retracted position toward its advanced position.

BEST MODE FOR CARRYING OUT THE INVENTION

Figure 1:
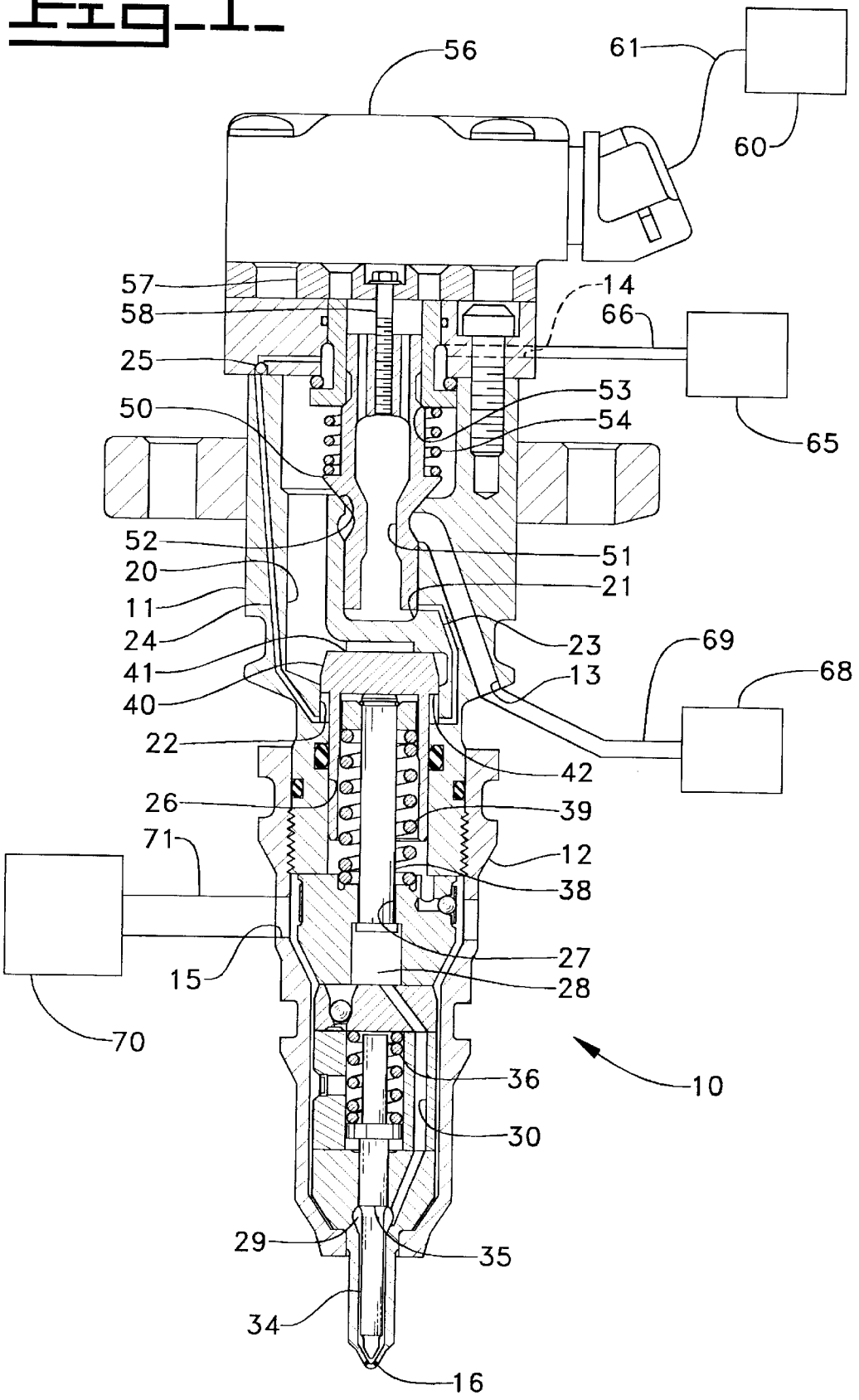
FIG. 1 is a sectioned side elevational diagrammatic view of a hydraulically-actuated fuel injection system according to the present invention.
Figure 2:
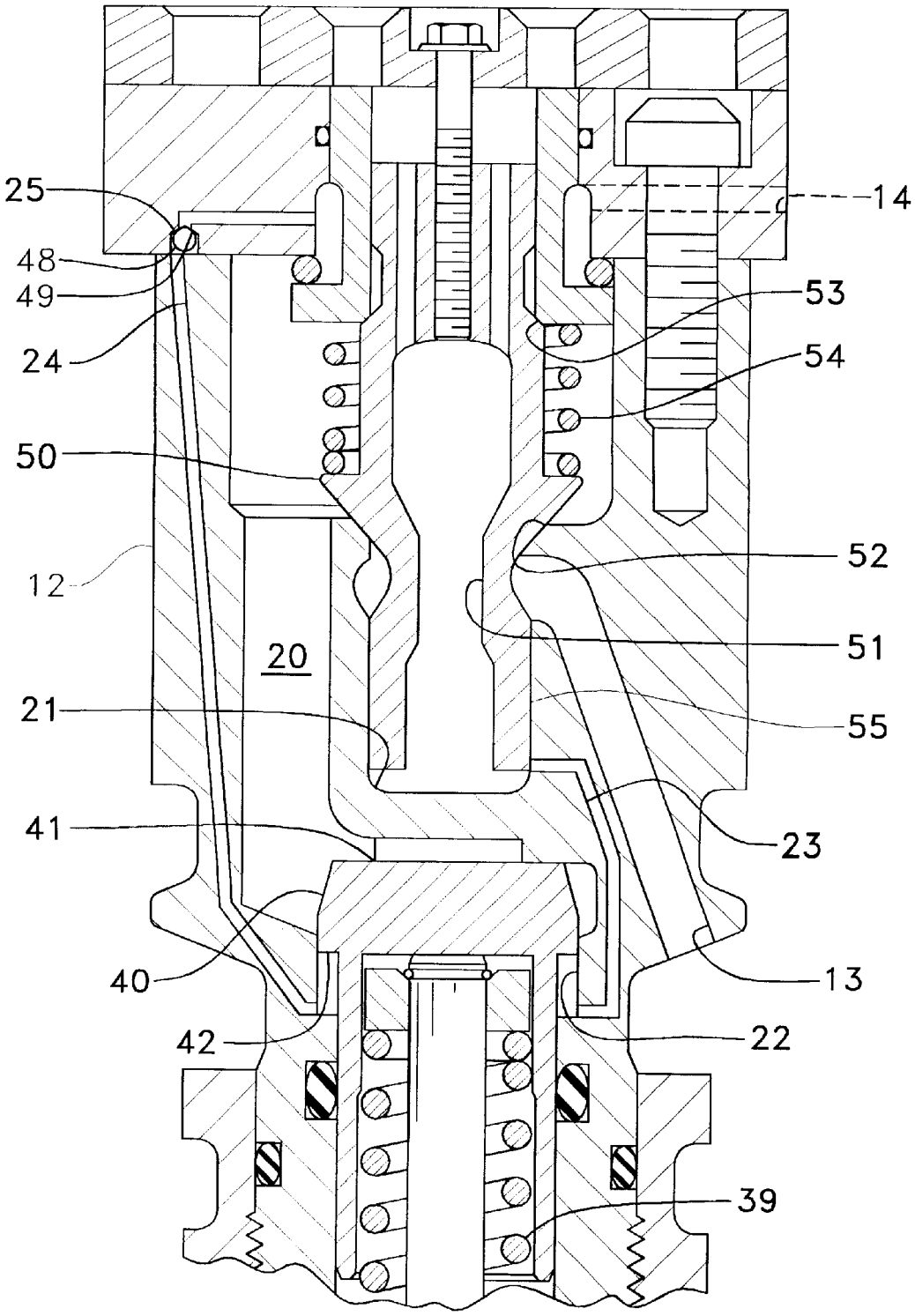
FIG. 2 is a partial sectioned diagrammatic view of a fuel injector according to the present invention.

Referring now to FIGS. 1–4, a hydraulically-actuated fuel injection system 10 includes one or more hydraulically-actuated fuel injectors 11. Each fuel injector includes an injector body 12 made up of various components attached to one another in a manner well known in the art. The injector body includes an actuation fluid inlet 13 connected to a source of high pressure actuation fluid 68 via a supply line 69, an actuation fluid drain connected to a low pressure reservoir 65 via a drain line 66, and a fuel inlet 15 connected to a source of low pressure fuel fluid 70 via a fuel supply line 71. Source 68 preferably contains pressurized engine lubricating oil, and source 70 preferably contains a medium pressure distillate diesel fuel. Injector body 12 also defines a nozzle outlet 16 that is appropriately positioned in the combustion space of an internal combustion engine (not shown).

Fuel injector 11 is controlled in its operation via a conventional electronic control module 60 that communicates with a solenoid 56 via a communication line 61, in a manner well known in the art. Solenoid 56 includes an armature 57 that is attached to a poppet control valve member 50 with a fastener 58. Control valve member 50 is normally biased downward by a biasing spring 54 to a position that closes high pressure seat 52. When solenoid 56 is energized, control valve member 50 is lifted against the action of spring 54 to a position that closes low pressure seat 53 and opens high pressure seat 52. The total movement distance of control valve member 50 between high pressure seat 52 and low pressure seat 53 is typically on the order of hundreds of microns. Each injection event is initiated by energizing solenoid 56 to open fluid communication between upper actuation fluid cavity 20 and actuation fluid inlet 13 past high pressure seat 52. Each injection event is ended by de-energizing solenoid 56 so that upper actuation fluid cavity 20 opens to actuation fluid drain 14 past low pressure seat 53.

Fuel injector 11 includes an intensifier piston 40 that is positioned in a piston bore 26 defined by injector body 12. Piston 40 is normally biased toward an upper retracted position, as shown, by a return spring 39. Piston 40 is hydraulically driven downward toward an advanced position during an injection event when the top primary hydraulic surface 41 is exposed to high fluid pressure in upper actuation fluid cavity 20.

A plunger 38 is attached to move with piston 40, and is positioned in a plunger bore 27. A portion of plunger bore 27 and plunger 38 define a fuel pressurization chamber 28 that communicates with nozzle outlet 16 via a nozzle chamber 29 and a nozzle supply passage 30. A needle valve member 34 is positioned in nozzle chamber 29 and moveable between an upward open position in which nozzle outlet 16 is open, and a downward closed position in which nozzle outlet 16 is blocked. Needle valve member 34 is normally biased downward toward its closed position by a needle biasing spring 36. Needle valve member 34 moves upward toward its open position when fuel pressure acting on lifting hydraulic surface 35 is sufficient to overcome needle biasing spring 36. Each injection event ends when fuel pressure in nozzle chamber 29 drops below a valve closing pressure sufficient to hold needle valve member 34 open against the action of spring 36.

In order to provide a more abrupt end to each injection event, piston 40 has been modified to include an opposing hydraulic surface 42 that is exposed to fluid pressure in a lower actuation fluid cavity 22, which is defined by piston 40 and injector body 12. In this embodiment, opposing hydraulic surface 42 takes the form of an annular shoulder. Lower actuation fluid cavity 22 is always open to a spill passage 23 on one side and a refill passage 24 on its opposite side. A check valve 25 is positioned in refill passage 24 to prevent flow of fluid from lower actuation fluid cavity 22 toward actuation fluid drain 14 via refill passage 24. However, when piston 40 is retracting upward between injection events, ball valve member 48 moves off of valve seat 49 of check valve 25 to allow low pressure fluid to be drawn into lower actuation fluid cavity 22 from actuation fluid drain 14.

When solenoid 56 is energized such that control valve member 50 is moved upward to close low pressure seat 53 and open high pressure seat 52, spill passage 23 is opened to a low pressure area 21. Low pressure area 21 is always in fluid communication with actuation fluid drain 14 via an internal passage 51 through control valve member 50 and other passageways not clearly visible in this view. Thus, as partially shown in FIG. 4, when solenoid 56 is energized, upper actuation fluid cavity 20 is open to actuation fluid inlet 13, but lower actuation fluid cavity 22 is opened to actuation fluid drain 14 via spill passage 23 and internal passage 51. This permits fluid in lower actuation fluid cavity 22 to escape into actuation fluid drain 14 when piston 40 is driven downward by the high fluid pressure in upper actuation fluid cavity 20. When solenoid 56 is de-energized, a side surface 55 of control valve member 50 covers and blocks port opening 19 of spill passage 23. When this occurs, lower actuation fluid cavity 22 becomes closed and prevent any further fluid from escaping. This in turn hydraulically locks piston 40, and prevents it from further downward movement.

INDUSTRIAL APPLICABILITY

Figure 3:
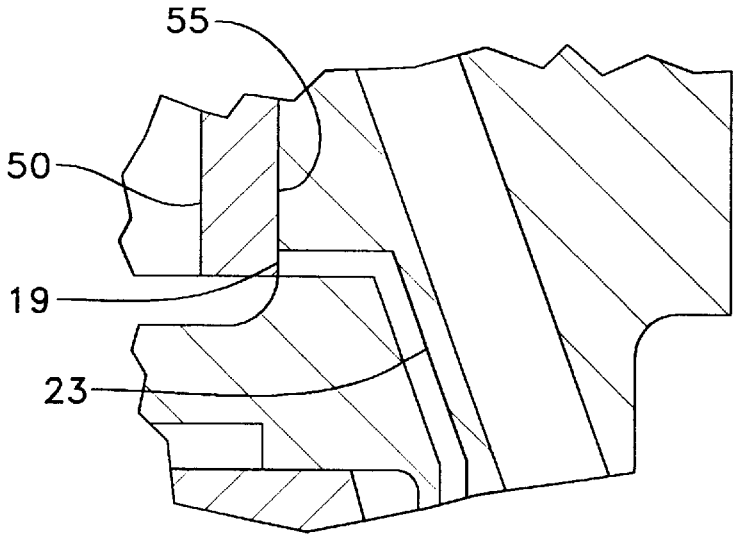
FIG. 3 is an enlarged sectioned partial diagrammatic view of the fuel injector of FIG. 2 when the control valve member is in its second position.
Figure 4:
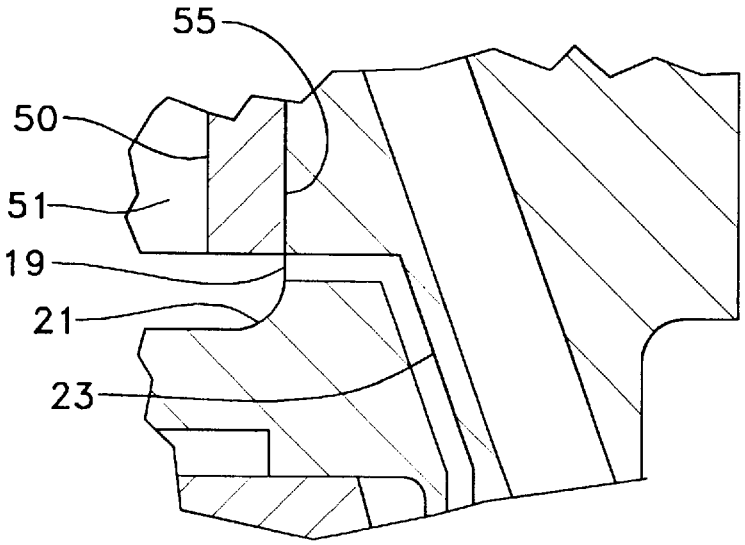
FIG. 4 is a view similar to that of FIG. 3 except showing the control valve member in its first position.

Between injection events, poppet valve member 50 is pushed downward by spring 54 to close high pressure seat 52 and open low pressure seat 53. When in this position, spill passage 23 is blocked by side surface 55, as shown in FIG. 3. The force provided by return spring 39 causes plunger 38 and piston 40 to retract upward to reset themselves for a subsequent injection event. This upward movement of piston 40 causes fluid in upper actuation fluid cavity 20 to be displaced toward actuation fluid drain 14 past low pressure seat 53. At the same time, this upward movement of piston 40 causes an amount of actuation fluid to be drawn into lower actuation fluid cavity 22 past check valve 25 and through refill passage 24 into the expanding volume of lower actuation fluid cavity 22.

Each injection event is initiated when solenoid 56 is energized. This causes control valve member 50 to lift against the action of spring 54 to close low pressure seat 53 and open high pressure seat 52. At the same time, this opens spill passage 23 to low pressure area 21. When poppet valve member 50 moves to this position, high pressure fluid flows into upper actuation fluid cavity 20 from actuation fluid inlet 13 past high pressure seat 52. This high pressure fluid acting on primary hydraulic surface 41 quickly builds to a magnitude that starts piston 40 and plunger 38 moving downward against the action of return spring 39. As piston 40 moves downward, fluid in lower actuation fluid cavity 22 is allowed to escape through spill passage 23, into low pressure area 21, and eventually into actuation fluid drain 14 via internal passage 51. As piston 40 and plunger 38 continue their downward movement, fuel in fuel pressurization chamber 28 becomes pressurized. Eventually, fuel pressure acting on lifting hydraulic surface 35 of needle valve member 34 is sufficient to move it upward to its open position against the action of spring 36 to allow fuel to commence spraying out of nozzle outlet 16.

Each injection event is ended by de-energizing solenoid 56. When this occurs, spring 54 pushes poppet control valve member 50 downward to close high pressure seat 52 and open low pressure seat 53. Simultaneously, side surface 55 of poppet valve member 50 covers and closes port 19 of spill passage 23. This abruptly closes lower actuation fluid cavity 22 and hydraulically prevents piston 40 from continuing its downward movement. Thus, both piston 40 and plunger 38 abruptly cease their downward motion. Since fuel pressure in fuel pressurization chamber 28 can only remain high if plunger 38 is moving downward, fuel pressure drops very rapidly. Thus, fuel pressure acting on lifting hydraulic surface 35 drops quickly below a valve closing pressure, and needle valve member 34 abruptly moves downward and closes nozzle outlet 16 under the action of biasing spring 36. Since fuel pressure has dropped so rapidly, needle valve member 34 can move toward its closed position much quicker, and provide a nearly abrupt end to the injection event.

In prior art hydraulically-actuated fuel injectors of this type, injection events ended much less abruptly since the only force available to arrest the downward momentum of plunger 38 and piston 40 came from return spring 39. Thus, in these prior art fuel injectors, fuel pressure decayed much more slowly. When fuel pressure drops more slowly, needle valve member 34 remains at least partially open for a significantly longer amount of time, and fuel at lower pressures continues to escape through nozzle outlet 16. The present invention achieves a much quicker drop in fuel pressure at the end of an injection event by hydraulically locking the plunger 40 and piston 38.

The above description is intended for illustrative purposes only, and is not intended to limit the scope of the present invention in any way. For instance, those skilled in the art will appreciate that the various passageways associated with the present invention can be rearranged from that shown in the illustrated embodiment without otherwise altering the functioning of the present invention. Thus, various modifications can be made to the illustrated embodiment without departing from the intended spirit and scope of the invention, which is defined in terms of the claims set forth below.

I claim:

1. A hydraulically actuated fuel injector comprising:

an injector body defining a first actuation fluid cavity, a second actuation fluid cavity, an actuation fluid inlet, a spill passage, a piston bore and a nozzle outlet;

a control valve member positioned in said injector body and being movable between a first position and a second position;

an intensifier piston positioned in said piston bore and being movable between a retracted position and an advanced position, and said piston having a primary hydraulic surface exposed to fluid in said first actuation fluid cavity, and an opposing hydraulic surface exposed to fluid in said second actuation fluid cavity;

said first actuation fluid cavity being open to said actuation fluid inlet, and said second actuation fluid cavity being open to said spill passage when said control valve member is in said first position; and said spill passage being blocked when said control valve member is in said second position.

2. The hydraulically actuated fuel injector of claim 1 wherein said injector body defines a refill passage extending between said second actuation fluid cavity and an actuation fluid drain; and a check valve operably positioned in said refill passage to prevent flow of fluid in said refill passage from said second actuation fluid cavity to said actuation fluid drain.

3. The hydraulically actuated fuel injector of claim 1 wherein said injector body further defines a fuel inlet connected to a source of fuel fluid; and said actuation fluid inlet is connected to a source of actuation fluid that is different from said fuel fluid.

4. The hydraulically actuated fuel injector of claim 1 wherein said primary hydraulic surface is a top of said piston; and said opposing hydraulic surface includes an annular shoulder.

5. The hydraulically actuated fuel injector of claim 1 wherein said second actuation fluid cavity is open to said actuation fluid drain via an internal passage through said control valve member when said control valve member is in said first position.

6. The hydraulically actuated fuel injector of claim 1 further comprising a solenoid mounted on said injector body and attached to said control valve member.

7. The hydraulically actuated fuel injector of claim 1 wherein said injector body defines a plunger bore fluidly connected to said nozzle outlet;

a plunger positioned in said plunger bore and being attached to move with said piston;

a portion of said plunger bore and said plunger defining a fuel pressurization chamber; and a needle valve member positioned in said injector body and being movable between an open position in which said nozzle outlet is open, and a closed position in which said nozzle outlet is blocked.

8. The hydraulically actuated fuel injector of claim 1 wherein said first actuation fluid cavity is open to said actuation fluid drain when said control valve member is in said second position.

9. A hydraulically actuated fuel injector comprising:

an injector body defining a first actuation fluid cavity, a second actuation fluid cavity, an actuation fluid inlet, an actuation fluid drain, a piston bore and a nozzle outlet;

a control valve member positioned in said injector body and being movable between a first position and a second position;

a solenoid mounted on said injector body and attached to said control valve member;

an intensifier piston positioned in said piston bore and being movable between a retracted position and an advanced position, and said piston having a primary hydraulic surface exposed to fluid in said first actuation fluid cavity, and an opposing hydraulic surface exposed to fluid in said second actuation fluid cavity;

said first actuation fluid cavity being open to said actuation fluid inlet, and said second actuation fluid cavity being open to said actuation fluid drain when said control valve member is in said first position; and said first actuation fluid cavity is open to said actuation fluid drain, and said second actuation fluid cavity being closed when said control valve member is in said second position.

10. The hydraulically actuated fuel injector of claim 9 wherein said primary hydraulic surface is a top of said piston; and said opposing hydraulic surface includes an annular shoulder.

11. The hydraulically actuated fuel injector of claim 10 wherein said second actuation fluid cavity is open to said actuation fluid drain via an internal passage through said control valve member when said control valve member is in said first position.

12. The hydraulically actuated fuel injector of claim 11 wherein said injector body defines a refill passage extending between said second actuation fluid cavity and said actuation fluid drain; and a check valve operably positioned in said refill passage to prevent flow of fluid in said refill passage from said second actuation fluid cavity to said actuation fluid drain.

13. The hydraulically actuated fuel injector of claim 12 wherein said primary hydraulic surface is a top of said piston; and said opposing hydraulic surface includes an annular shoulder.

14. The hydraulically actuated fuel injector of claim 13 wherein said injector body further defines a fuel inlet connected to a source of fuel fluid; and said actuation fluid inlet is connected to a source of actuation fluid that is different from said fuel fluid.

15. The hydraulically actuated fuel injector of claim 14 wherein said injector body defines a plunger bore fluidly connected to said nozzle outlet;

a plunger positioned in said plunger bore and being attached to move with said piston;

a portion of said plunger bore and said plunger defining a fuel pressurization chamber; and a needle valve member positioned in said injector body and being movable between an open position in which said nozzle outlet is open, and a closed position in which said nozzle outlet is blocked.

16. A hydraulically actuated fuel injection system comprising:

a fuel injector having an actuation fluid inlet, a fuel inlet, a nozzle outlet and means, including a hydraulically driven piston, for pressurizing fuel in said fuel injector;

a source of high pressure actuation fluid connected to said actuation fluid inlet;

a source of low pressure fuel connected to said fuel inlet; and means, including said fuel injector having a first actuation fluid cavity, a second actuation fluid cavity, and one of a spill passage and an actuation fluid drain, for hydraulically stopping said piston when said piston is moving from a retracted position toward an advanced position.

17. The hydraulically actuated fuel injection system of claim 16 wherein said piston includes an opposing hydraulic surface exposed to fluid in an actuation fluid cavity defined at least partially by said fuel injector; and said means for hydraulically stopping includes means for closing said actuation fluid cavity.

18. The hydraulically actuated fuel injection system of claim 17 wherein said means for closing includes a solenoid actuated control valve attached to said fuel injector.

19. The hydraulically actuated fuel injection system of claim 18 wherein said piston includes a primary hydraulic surface, and said fuel injector has an actuation fluid drain;

said control valve is movable between a first position and a second position; and said primary hydraulic surface is exposed to fluid pressure in said actuation fluid inlet, and said actuation fluid cavity is open to said actuation fluid drain when said control valve is in said first position.

20. The hydraulically actuated fuel injection system of claim 19 wherein said control valve blocks fluid communication between said actuation fluid cavity and said actuation fluid drain when in said second position.

* * * * *